US007207457B2

(12) United States Patent
Schwarz

(10) Patent No.: US 7,207,457 B2
(45) Date of Patent: Apr. 24, 2007

(54) CLOSURE WITH TEAR STRIP

(75) Inventor: Stefan H. Schwarz, Orion Township, MI (US)

(73) Assignee: Letica Corporation, Rochester, MI (US)

( * ) Notice: Subject to any disclaimer, the term of this patent is extended or adjusted under 35 U.S.C. 154(b) by 186 days.

(21) Appl. No.: 10/752,756

(22) Filed: Jan. 7, 2004

(65) Prior Publication Data

US 2005/0145628 A1 Jul. 7, 2005

(51) Int. Cl.
*B65D 17/40* (2006.01)
*B65D 41/16* (2006.01)

(52) U.S. Cl. ..... 220/276; 220/782; 220/795; 220/673; 220/675

(58) Field of Classification Search ..... 220/276, 220/382, 669, 673, 675, 780, 782, 795; 215/256, 215/305

See application file for complete search history.

(56) References Cited

U.S. PATENT DOCUMENTS

| | | | | | |
|---|---|---|---|---|---|
| 801,282 | A | * | 10/1905 | Weissenthanner | 215/253 |
| 3,367,524 | A | * | 2/1968 | Lake | 215/256 |
| 4,281,774 | A | * | 8/1981 | Mumford | 220/270 |
| 4,457,447 | A | * | 7/1984 | Kirkis | 220/784 |
| 4,512,493 | A | * | 4/1985 | Von Holdt | 220/782 |
| 4,625,876 | A | * | 12/1986 | Bullock, III | 215/256 |
| 4,711,364 | A | | 12/1987 | Letica | |
| 4,735,337 | A | | 4/1988 | Von Holdt | |
| 4,790,448 | A | * | 12/1988 | Ostrum et al. | 220/270 |
| 4,798,301 | A | * | 1/1989 | Bullock et al. | 215/256 |
| 4,930,656 | A | | 6/1990 | Blanchette | |
| 5,103,993 | A | * | 4/1992 | Bingisser | 220/782 |
| 5,238,135 | A | | 8/1993 | Landis | |
| 5,617,968 | A | | 4/1997 | Luburic | |
| 5,626,251 | A | | 5/1997 | Luburic et al. | |
| 5,730,309 | A | | 3/1998 | Jiradejnunt et al. | |
| 5,769,255 | A | * | 6/1998 | Ohmi et al. | 215/345 |
| 5,873,484 | A | * | 2/1999 | Clute et al. | 220/276 |
| 6,279,774 | B1 | | 8/2001 | Clute et al. | |
| 6,382,445 | B1 | * | 5/2002 | McCandless | 215/341 |
| 6,543,635 | B2 | * | 4/2003 | Ciccone | 220/276 |
| 6,619,498 | B2 | | 9/2003 | von Holdt, Jr. | |
| 6,688,483 | B2 | | 2/2004 | Davis | |
| 6,779,676 | B2 | * | 8/2004 | Ciccone | 220/276 |
| 2001/0047994 | A1 | | 12/2001 | von Holdt, Jr. | |
| 2002/0148834 | A1 | | 10/2002 | Luburic | |
| 2003/0168460 | A1 | | 9/2003 | von Holdt, Sr. et al. | |

* cited by examiner

*Primary Examiner*—Anthony D. Stashick
*Assistant Examiner*—James Smalley
(74) *Attorney, Agent, or Firm*—Young & Basile, P.C

(57) ABSTRACT

A closure for covering an opening of a container. The closure includes an inverted U-shaped peripheral channel for receiving the rim of a container therein. A tear strip is formed with the skirt of the closure via a tear line that circumscribes the skirt. A breakaway pull tab having an inner surface with U-shaped ribs, the combination of the surface and ribs being such as to provide a concavity which assists in gripping the tab to pull the strip away. Linear vertical ribs may be provided on the outer surface to provide further assistance in the gripping function. The skirt includes a recessed area underlying the pull tab for providing access to the pull tab. An alternative embodiment uses a zig-zag structure of strengthening ribs in the skirt to reduce the amount of material necessary to provide the undercut. This reduces the probability of warpage in the closure structure.

5 Claims, 6 Drawing Sheets

CLOSURE WITH TEAR STRIP

FIELD OF THE INVENTION

This invention relates to plastic container/closure combinations and more particularly to an improved closure structure.

BACKGROUND OF THE INVENTION

Injection molded plastic containers and lock-on closures are in popular use for packaging a wide variety of products in quantities of one to six gallons. Examples include asphalt sealant, paint, drywall putty and food products. The "lock-on" feature is typically provided by an undercut in the closure which snaps around a peripheral edge flange in the open top of the container. The hoop strength of the closure is such that means must be designed into the closure to facilitate its removal. The two most common such means include (1) tear strips which are removed to reduce the force of the locking mechanism and (2) windows or apertures in the closure skirt which permit the skirt to be fractured at several circumferentially spaced locations. These mechanisms can also be used in combination.

Prior art tear strips can be difficult for a user to access and to grip as the tab is broken away and the tear strip is removed from the outer periphery of the closure. To solve this problem, some prior art closures have been designed to provide a tab that protrudes outwardly from the skirt of the closure for easier access. However, this method prevents efficient stacking of closures for storage.

Efforts to design strength into the closure generally involve adding thickness to the closure skirt. This approach uses additional plastic material, adds weight and can give rise to warpage problems in critical areas of the closure.

SUMMARY OF THE INVENTION

The present invention provides an improved closure for an open top container which solves the problems found in the prior art. The closure includes an integral skirted rim which receives the upper edge of the container therein. In one form, a tear strip is formed with and in the skirt but can be separated therefrom via a tear line that extends around the skirt. An essentially flush pull tab is positioned on the end of the strip directly over a recess in the skirt wall which provides room to grasp the tab.

In the preferred embodiment of the tear strip aspect of the invention, the pull tab includes an inner gripping surface having ribs formed therein in such a way as to form a concavity which adds to the effectiveness of the grip. An outer surface of the pull tab includes one or more substantially linear ribs protruding in a substantially vertical arrangement therefrom. The combination of ribs and the recessed grip area provides a more secure grip for tearing the pull tab away from a frangible connection. Once the pull tab has been broken away, the ribs provide a gripping feature to facilitate the removal of the tear strip from the closure skirt. The recessed area further includes an opening formed in the skirt wall around the perimeter of the pull tab. The opening forms an arrow shaped element indicating the direction for pulling and removing the tear strip from the skirt.

Another aspect of the invention involves the design of a zig-zag rib structure into the interior of the closure to reduce material, add strength, and minimize warpage.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 3:
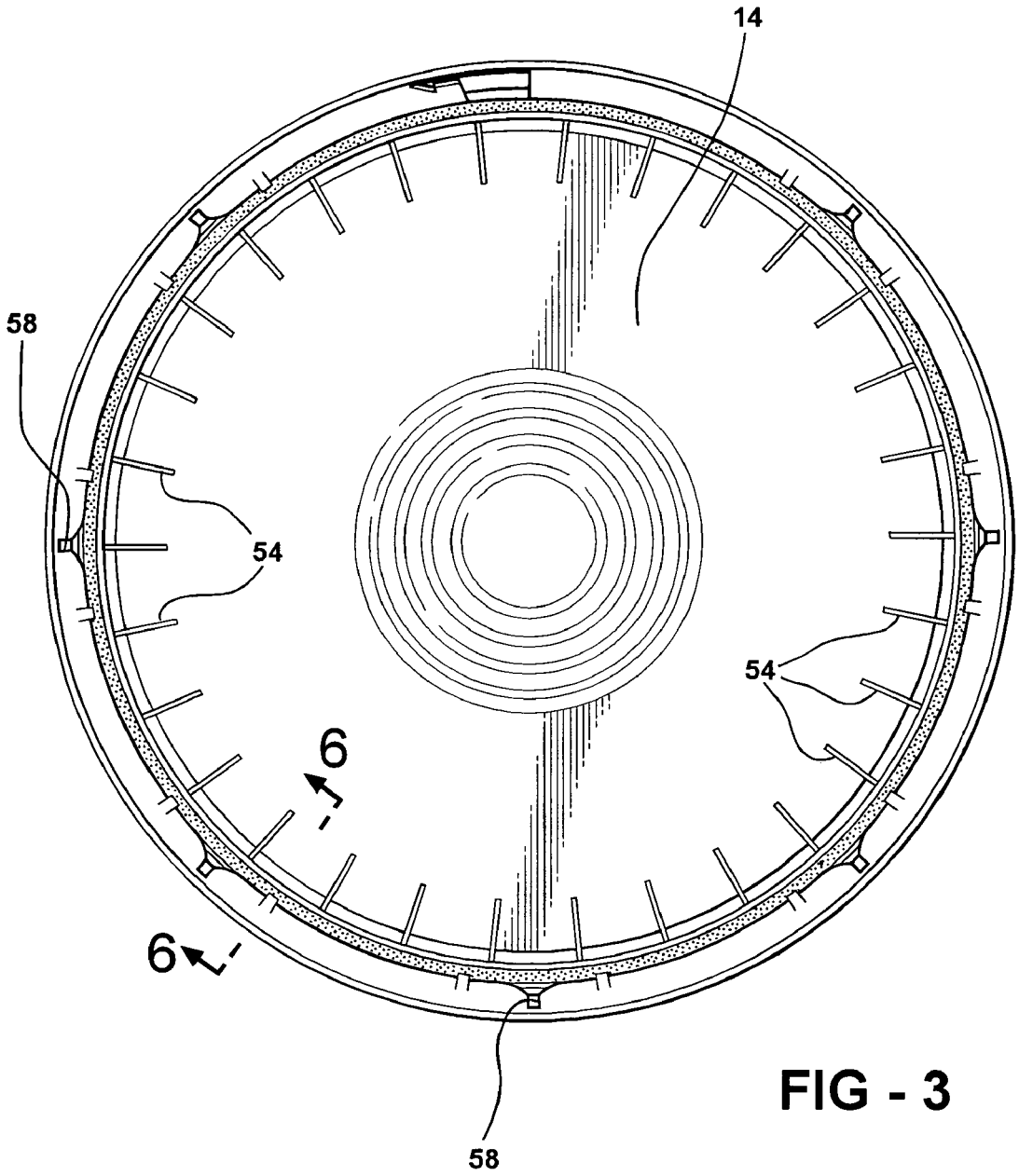
FIG. 3 is a bottom plan view of the resealable closure of FIG. 1.
Figure 4:
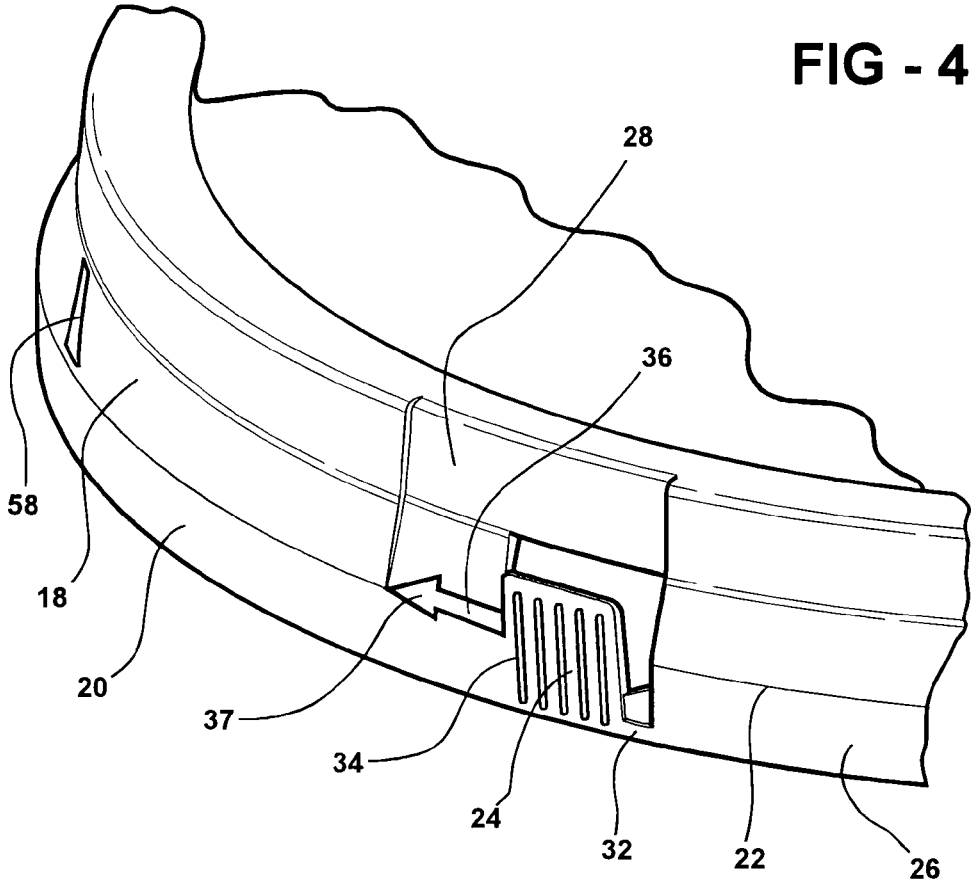
FIG. 4 is an enlarged partial perspective view showing a pull tab on the resealable closure of FIG. 1.

FIGS. 1–6 illustrate a first embodiment of the invention as the combination of an injection molded plastic closure 10 and an open top cylindrical container 12 of three to six gallon capacity. In such capacity, the closure is about 12 inches in outside diameter; these size and capacity numbers are given by way of example only. The material is preferably polyethylene but may also be polypropylene and/or other moldable polymers. The closure 10 includes a substantially planar deck portion 14 peripherally bounded by an inverted U-shaped channel 16, to receive the upper rim 15 of container 12, and a peripheral skirt 18 which overlies the upper wall of the container when installed. A tear strip 20 is formed integrally with the skirt 18 in the injection molding process. The tear strip 20 is removable from the skirt 18 via a tear line 22 of substantially reduced thickness and tensile strength relative to the rest of the skirt 18. A breakaway pull tab 24 is positioned substantially flush with an outer portion 26 of the skirt 18. The pull tab 24 is integral with the tear strip 20 and is operable to facilitate removing the tear strip 20 from the skirt 18 such that the closure 10 becomes more easily removed from the container 12. Once the tear strip 20 has been removed, the locking strength between the closure 10 and the container 12 is reduced but not to zero; therefore, the closure 10 can be reapplied to the container 12. A recessed area 28 is formed in the skirt 18 adjacent an inner portion of the pull tab 24 for providing access to the pull tab 24. The recessed area 28 is formed from an area of reduced wall thickness relative to the remainder of the skirt 18 as best shown in FIG. 4.

Both embodiments of the invention are shown with cylindrical designs. It is to be understood that the improvements disclosed herein can also be used with non-cylindrical designs including oval, square and rectangular.

In the present embodiment, the outer wall of the container 12 is configured to provide an undercut 52 which provides the primary lock between the closure 10 and container 12 in conventional fashion both before and after removal of the tear strip.

A circumferential rib 53 may be formed in the container wall below the undercut 52 to protrude into the interior groove formed by the tear lid 22 to provide a second, supplemental lock which is operable only until such time as the tear strip 20 is removed. A second rib 55 may be formed on the container 12 to immediately underlie the closure skirt 18 to impede access to the lower edge of the skirt with a tool or one's fingers before the tear strip is removed.

Those skilled in the art will appreciate that the tear strip 20 is not limited to use with double lock closures but may also be used with single lock closures simply to reduce the hoop strength of the closure skirt 18 to facilitate post-tearing removal of the closure 12. In this regard, windows or apertures 58 are provided at 45 degree intervals around the skirt 18 to facilitate lifting and bending of the skirt 18 after removal of the strip 20.

Figure 7:
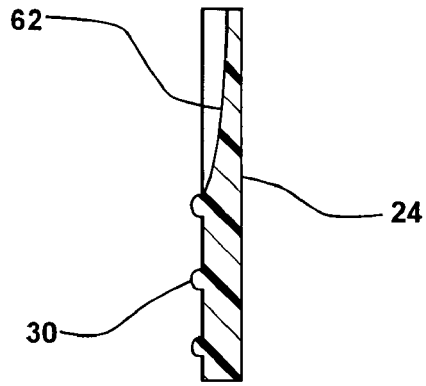
FIG. 7 is a section through the pull tab.
Figure 5:
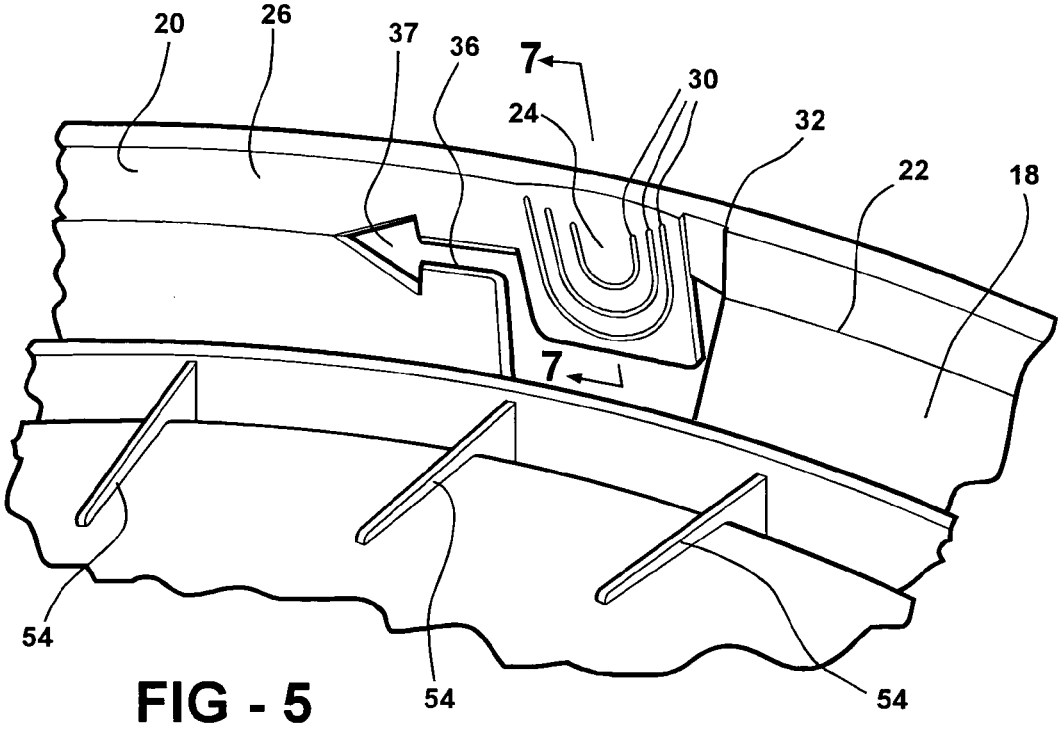
FIG. 5 is an enlarged perspective view showing the inner surface of the pull tab of FIG. 4.

The pull tab 24 includes a concave inner surface 62 best seen in FIGS. 5 and 7, having several parallel U-shaped ribs 30 protruding therefrom. The U-shaped ribs 30 in combination with the concave shape provide a gripping surface for breaking the tab 24 away from frangible area 32 of the skirt 18. Concavity may be provided in one of three ways: either the inner surface can be concave and the ribs of equal height, or the inner surface flat and the ribs of increasing height from inside to outside, or a combination of the two can be used. The pull tab 24 includes an outer gripping surface (best seen in FIG. 4) having at least one but preferably three or more substantially linear shaped ribs 34 protruding in a substantially vertical arrangement therefrom. The vertical ribs 34 provide a gripping surface to pull the pull tab 24 around the periphery of the closure 10 to remove the tear strip 20 from the skirt 18. The recessed area 28 includes an opening 36 formed in the skirt 18 around the perimeter of the pull tab 24. The opening 36 has an arrow shape 37 formed on one end thereof for defining the direction of pull to remove the tear strip 20 from the skirt 18.

Figure 1:
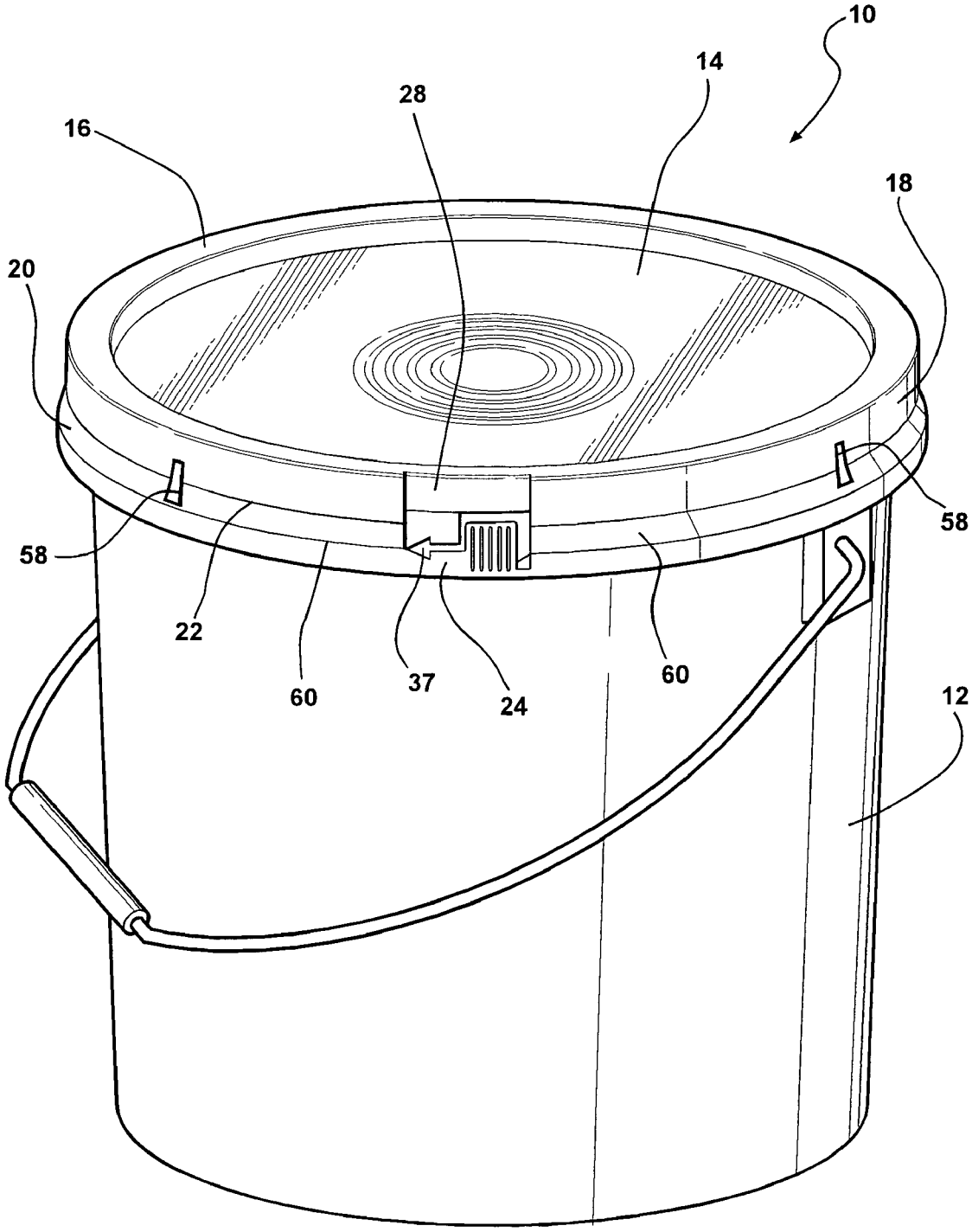
FIG. 1 is a perspective view of a resealable closure attached to a container.
Figure 2:
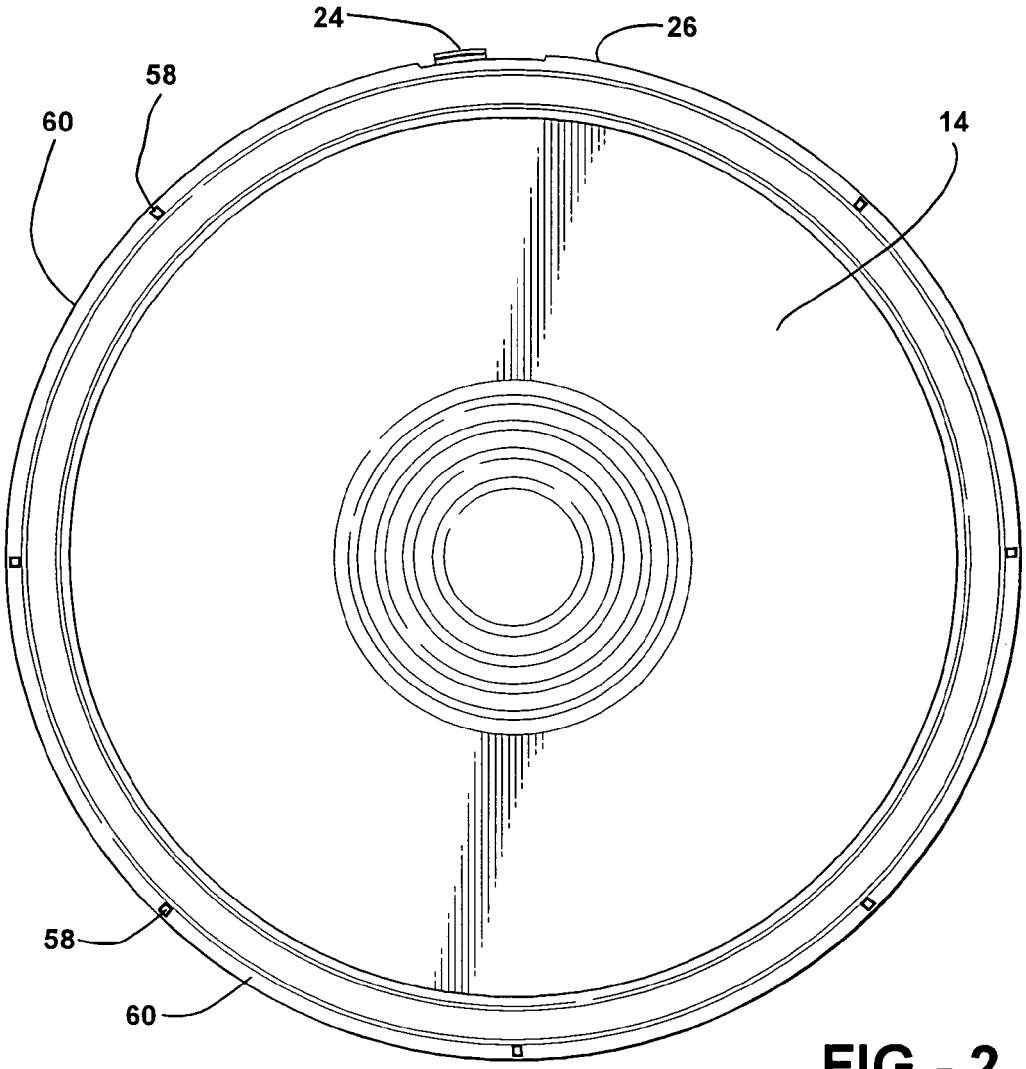
FIG. 2 is a top plan view of the resealable closure of FIG. 1.
Figure 6:
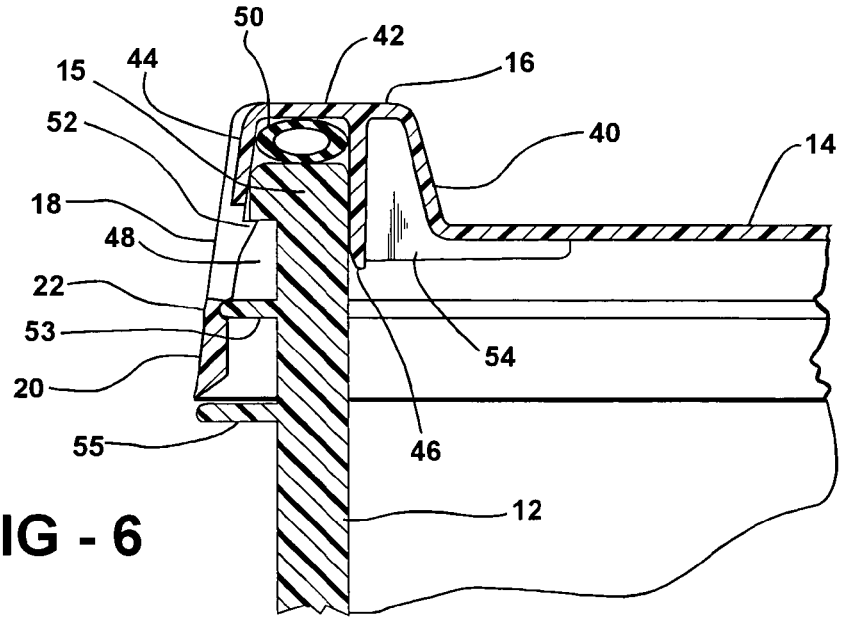
FIG. 6 is a cross-sectional view taken along lines 6—6 in FIG. 3.

Referring now more particularly to FIG. 6, the channel portion 16 includes a slightly inwardly angled inner wall 40 extending upwardly from the planar deck portion 14. The channel portion 16 is further defined by a substantially horizontal annular connector 42 integrally extending from the inner wall 40 to an outer wall 44. An intermediate wall 46 extends downward from an inner surface of the horizontal connector 42 between the inner 40 and outer 44 walls to define an inverted U-shaped channel 48. An O-ring gasket 50 is positionable in the inverted U-shaped channel 48 to seal the closure 10 to the container 12.

The closure 10 includes a plurality of stiffening ribs 54 located on the underside thereof (best seen in FIGS. 3 and 5). The stiffening ribs 54 provide stiffness to the closure 10 so that the closure 10 has enough structural integrity to remain connected to the container 12 under stacking loads, but still allows the closure 10 to be deformed sufficiently for removal of the closure 10 from the container 12. The closure 10 includes a plurality of through apertures 58 that can be seen in FIGS. 1–4. The through apertures 58 are spaced apart from one another along the perimeter of the skirt 18. The apertures 58 are operable for separating the perimeter of the skirt 18 into eight discreet sections 60. Other numbers from six to 12 can also be used. After the tear strip 20 is removed from the skirt 18, the discreet sections 60 allow the user to pry upward to deform the closure 10 enough to move the projection 52 away from the rim 53 of the container 12 and thus allow removal of the closure 10.

In operation, when the closure 10 and container 12 are first attached to one another during manufacturing, the closure 10 cannot readily be manually separated from the container 12, thus ensuring safe storage of the contents of the container 12. The closure 10 is tamper resistant and tamper-evident because the closure 10 cannot normally be opened until the tear strip 20 has been removed from the skirt 18. To remove the closure 10, a user must pull the pull tab 24 away from the skirt 18 and break the pull tab 24 from the skirt 18 along a frangible portion 32 of the skirt. The U-shaped ribs 30 located on the inner surface of the pull tab 24 provides gripping to facilitate breakage from the frangible area 32. The pull tab 24 is more easily accessed because recessed area 28 is provided to allow the user's fingers to reach behind the pull tab 24. The recessed area 28 allows access to the inner surface where the user's fingers can grip the U-shaped ribs 30 and pull the pull tab 24 apart from the skirt 18 along frangible area 32. Once the pull tab has been broken away, the user then pulls the pull tab 24 in the direction of the arrow 37 using the linear vertical gripping ribs 34 on the outer surface of the pull tab 24. The pull tab 24 stays connected to the tear strip 20 as the tear strip is being removed from the skirt 18 along tear line 22. Once the tear strip 20 has been completely removed from the skirt 18, the closure 10 can then be removed from the container 12. The closure 10 can also be reattached to the container 12 in a tightly sealed arrangement using the inverted U-shaped channel 48 to position the O-ring 50 seal.

Figure 8:
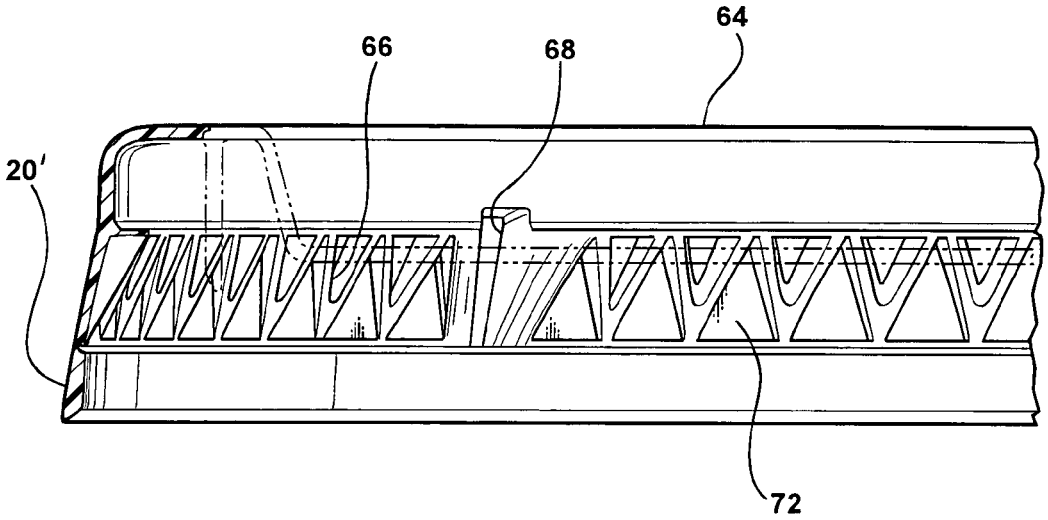
FIG. 8 is an interior view of another embodiment of the invention showing the anti-warpage pattern in the interior of the closure.
Figure 9:
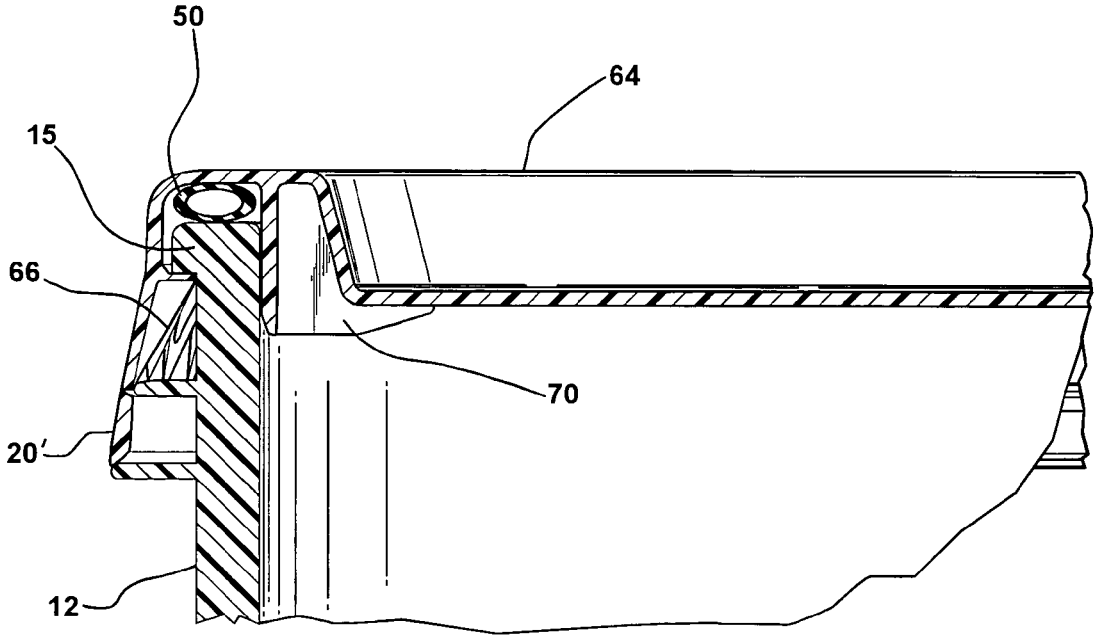
FIG. 9 is a cross-section showing the container and closure in combination.
Figure 10:
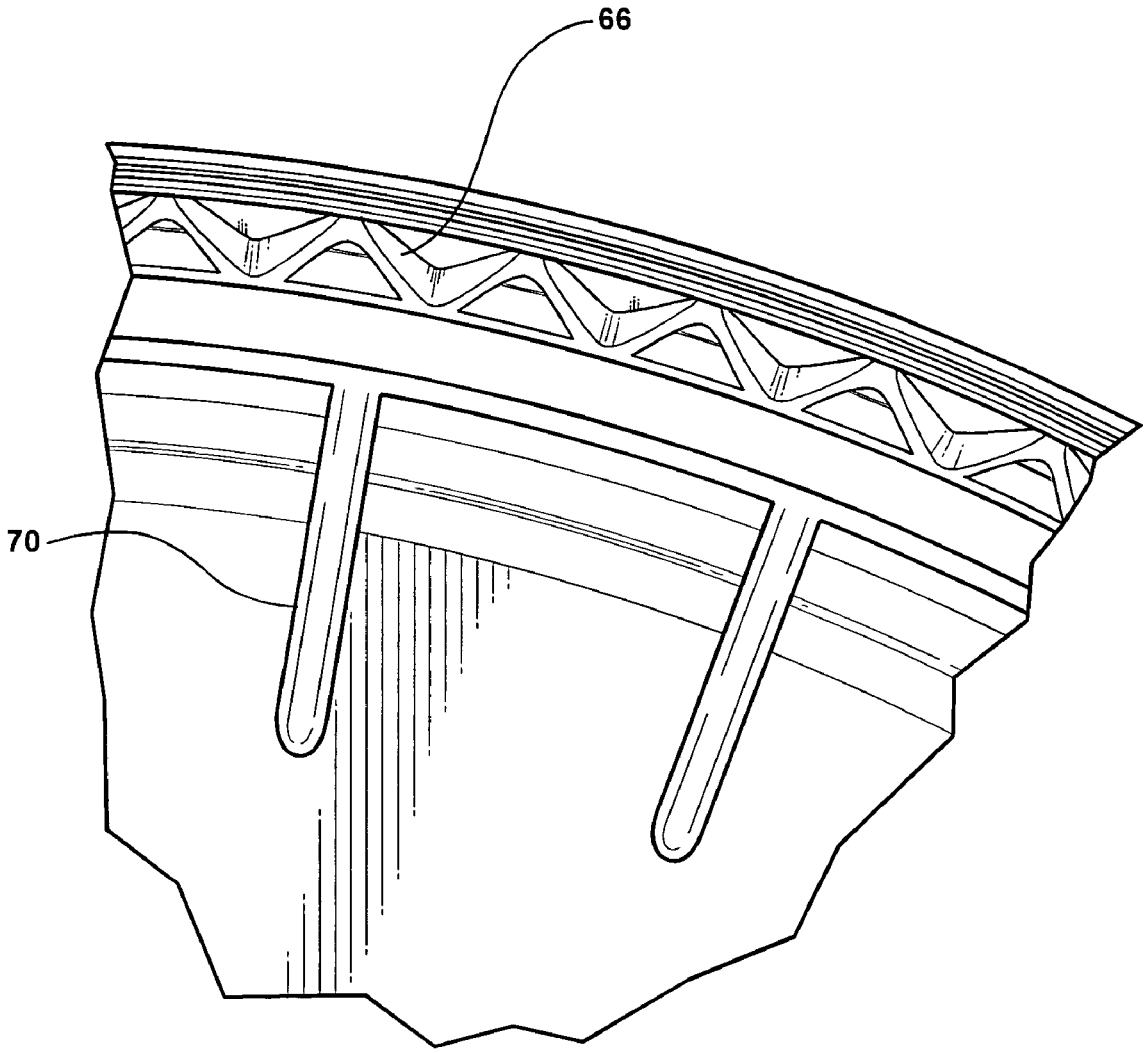
FIG. 10 is a detail of the closure interior.

Referring now to FIGS. 8–10, a second embodiment of the invention which adds hoop strength to the closure skirt while at the same time reducing material and the probability of warpage in the closure dimensions is shown. In this embodiment, closure 64. although similar to closure 10, differs from closure 10 in the addition of a zig-zag rib structure 66 on the interior of the rib skirt above the tear strip 20'. The zig-zag rib structure 66 is interrupted by windows or apertures 68 at approximately 45° intervals, such apertures 68 corresponding generally to the apertures 58 shown in the embodiment of FIG. 3. The rib structure 66 preferably comprises V-shaped elements which are joined at the top but can be spaced from one another at the top if desired. The thickness of material 72 between the rib structure 66 can be kept fairly thin while still providing the undercut which extends under peripheral lip or flange 15 of the container 12 as shown in FIG. 9. While shown in combination with a tear strip embodiment, the zig-zag or alternating V-shaped rib structure on the interior of the closure 64 may also be used in a non-tear strip design, wherein the windows or apertures 68 are used to break or split the skirt of the closure into a number of segments which can be levered upwardly to facilitate removal of the closure from the container 12. The second embodiment also includes ribs 70 which correspond essentially in structure and function to the ribs 54 shown in FIG. 5.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A molded plastic closure for an open top, industrial container of the type having an undercut top rim and wherein said enclosure comprises:

a central deck portion;

an inverted, U-shaped channel portion peripherally of said deck portion to receive and lock onto said undercut top rim;

said channel portion comprising substantially parallel and concentric, but radially spaced, inner and outer walls, said outer wall defining an inwardly extending locking flange for cooperation with said undercut rim;

said outer wall being integrally formed with an outwardly flaring skirt having an annular lower end portion; and a substantially continuous pattern of V-shaped ribs formed around and on the inside of said skirt, each V-shaped rib being integral with and extending from said flange to said lower end portion to increase the strength of at least said skirt;

said molded plastic closure further including a tear line extending circumferentially around the lower end portion of said skirt and immediately below the bottoms of said V-shaped ribs:

an opening in said skirt to interrupt said tear line and define a tear strip;

a breakaway pull tab integral with said tear tab; and a plurality of U-shaped space parallel ribs formed on the inside surface of said pull tab and defining, in combination with the inside surface of said pull tab, an overall concavity to enhance manual gripping of said pull tab to remove said tear band.

2. A molded plastic closure as defined in claim 1 wherein said V-shaped ribs are arranged in circumferential groups with openings between said groups.

3. A molded plastic closure as defined in claim 1 wherein said central deck is recessed relative to said channel portion to define a vertical step inwardly spaced from said inner wall; and a plurality of radial ribs disposed between said inner wall and said steps and integral therewith.

4. A molded plastic closure for an open top industrial container of the type having an externally undercut top rim, wherein said closure comprises:

a central deck portion;

an inverted, U-shaped channel portion integrally peripheral to said deck portion to receive and lock on to said container; said channel portion comprising substantially parallel and concentric, radially spaced inner and outer walls, said outer wall having an inwardly extending locking flange for cooperation with said undercut container;

said outer wall being integrally formed with a downwardly-extending skirt having an annular lower end portion; a tear line formed in said skirt above and parallel to said lower end portion to define a tear strip having an integral, break away pull tab with inner and outer surfaces;

a plurality of spaced vertical outwardly extending traction ribs formed on the outside surface of said pull tab; and a plurality of spaced, parallel U-shaped ribs formed integrally on the inside surface of said pull tab; the combination of said inside surface ribs and said inner surface being such as to define an overall concavity to improve gripping traction on said pull tab including an arrowhead-shaped opening formed in said skit adjacent the pull tab and extending into the tear line to indicate the direction of tearing along said tear line.

5. A molded plastic closure as defined in claim 4 further including a substantially continuous pattern of contiguous V-shaped ribs formed on the inside surface of said skirt and extending downwardly from said flange toward said lower end portion to add hoop strength to at least said skirt.

* * * * *